US005729925A

United States Patent [19]

Prothero

[11] Patent Number: 5,729,925

[45] Date of Patent: Mar. 24, 1998

[54] ILLUMINATED EMERGENCY SIGN UTILIZING LED UNITS

[75] Inventor: Elmer Eugene Prothero, Schaumburg, Ill.

[73] Assignee: Cooper Industries, Inc., Houston, Tex.

[21] Appl. No.: 405,188

[22] Filed: Mar. 16, 1995

[51] Int. Cl.[6] ..... G09F 13/04

[52] U.S. Cl. ..... 40/570; 362/800; 403/329

[58] Field of Search ..... 40/570; 403/329; 362/800

[56] References Cited

U.S. PATENT DOCUMENTS

| | | | |
|---|---|---|---|
| 3,309,806 | 3/1967 | Gallagher | 40/570 |
| 3,869,641 | 3/1975 | Goldberg . | |
| 4,939,426 | 7/1990 | Menard et al. . | |
| 4,967,317 | 10/1990 | Plumly | 40/570 X |
| 5,036,442 | 7/1991 | Brown | 362/800 X |
| 5,279,335 | 1/1994 | Bassi | 430/329 X |
| 5,309,950 | 5/1994 | Bassi et al. | 403/329 X |
| 5,365,411 | 11/1994 | Rycroft et al. | 40/570 X |
| 5,388,357 | 2/1995 | Malita | 40/570 |
| 5,416,679 | 5/1995 | Ruskovski et al. | 40/570 X |
| 5,446,440 | 8/1995 | Gleason et al. | 40/570 X |
| 5,459,955 | 10/1995 | Ruskovski et al. | 40/570 |
| 5,463,280 | 10/1995 | Johnson . | |

*Primary Examiner*—Anthony Knight
*Assistant Examiner*—Andrea Chop
*Attorney, Agent, or Firm*—Burns, Doane, Swecker & Mathis, L.L.P.

[57] ABSTRACT

An emergency exit sign has a housing in which a pair of LED units are disposed. Each LED unit has two rows of diodes, the rows connected in reverse polarity to an A.C. source so that said rows are illuminated alternatingly. A diffuser plate disposed between the LED units and a stencil plate is formed of a translucent plastic material having a light transmittance frequency to the peak wavelength of light emitted from the diodes. The diodes are exposed to the diffuser plate so that the diffuser plate receives both direct and indirect light therefrom.

2 Claims, 4 Drawing Sheets

ILLUMINATED EMERGENCY SIGN UTILIZING LED UNITS

BACKGROUND OF THE INVENTION

The present invention relates to illuminated emergency signs, such as exit signs.

Illuminated emergency signs, such as exit signs, are known which comprise a housing having one or more visible faces for displaying a message with letters or pictographs, such as "exit." The message is formed in a stencil which is illuminated by a light source from within the sign housing. A diffuser plate of translucent plastic (e.g., of red color) is situated between the light source and the stencil for diffusing the light.

Traditionally, light sources in the form of incandescent or fluorescent lamps have been used, but more recently, a light source in the form of an LED arrangement (light emitting diodes) has been used to take advantage of the economic efficiency of LED's.

A prior art sign is depicted in FIG. 9 with end portions thereof broken away to reveal a pair of LED units 2, 3, each including a plurality of diodes 4. The units 2, 3 are arranged against respective end walls 5, 6 of the sign housing so that the diodes 4 of each unit face the diodes 4 of the other unit.

In another known sign, LED units have been spaced inwardly from the side walls with diodes projecting from both sides of each LED unit. Thus, each unit would have a vertical row of diodes projecting toward one end wall of the housing and a vertical row of diodes projecting toward the other end wall. Each diode unit is enclosed within a reflector channel, whereby essentially no direct light from the diodes strikes the diffuser.

While LED's are more economically efficient than other types of light sources, it has proven to be difficult to obtain sufficient illumination in the absence of providing a large number of LED's. That is, much of the illumination of the LED's is lost through reflection before reaching the stencil.

It would be desirable to provide a cost-efficient LED arrangement which produces an ample amount of illumination.

Also, it would be desirable to enable existing emergency signs to be easily retrofit with an LED light source.

It would also be desirable that light be transmitted from the LED arrangement to the stencil with minimal loss of intensity.

SUMMARY OF THE INVENTION

The present invention relates to an emergency sign comprising a housing forming an interior chamber having opposing sides. A stencil plate extends across at least one of the sides and forms indicia. An illumination unit is disposed in the chamber and includes a plurality of groups of vertically spaced light-emitting diodes connected to an A.C. power source. The diodes of each group are electrically connected in series. One of the groups of diodes is connected in reverse polarity relative to the other group so that the groups are illuminated alternatingly. A diffuser plate is disposed between the illumination unit and the stencil plate for diffusing light emitted from the diodes.

The diodes emit light having a peak wavelength, and the diffuser is formed of a translucent plastic material having a light transmittance frequency, preferably equal to the peak wavelength of the light.

The illumination unit preferably includes a mounting plate having a hole. The illumination unit includes an LED unit which includes a body portion carrying the diodes, and an anchoring portion of generally cylindrical shape and including resilient locking fingers. The anchoring portion is insertable through the hole and is securable therein by the resilient locking fingers.

The diodes are preferably exposed directly to the diffuser plate such that the diffuser plate receives both direct and indirect light therefrom.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
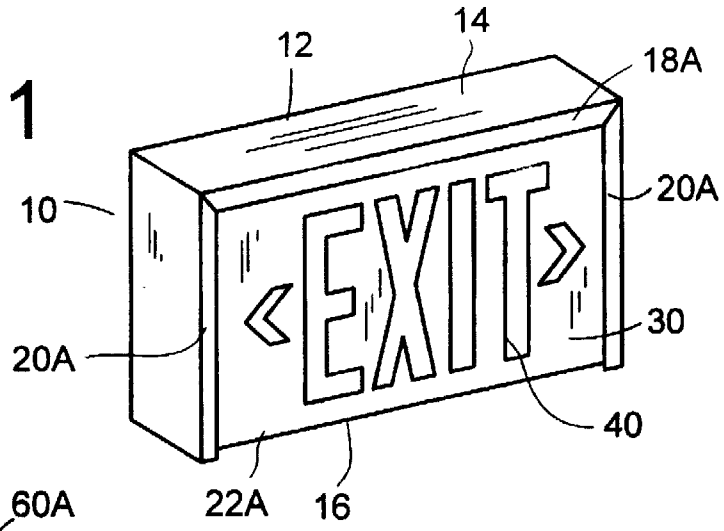
FIG. 1 is a front perspective view of an emergency sign according to the present invention.
Figure 2:
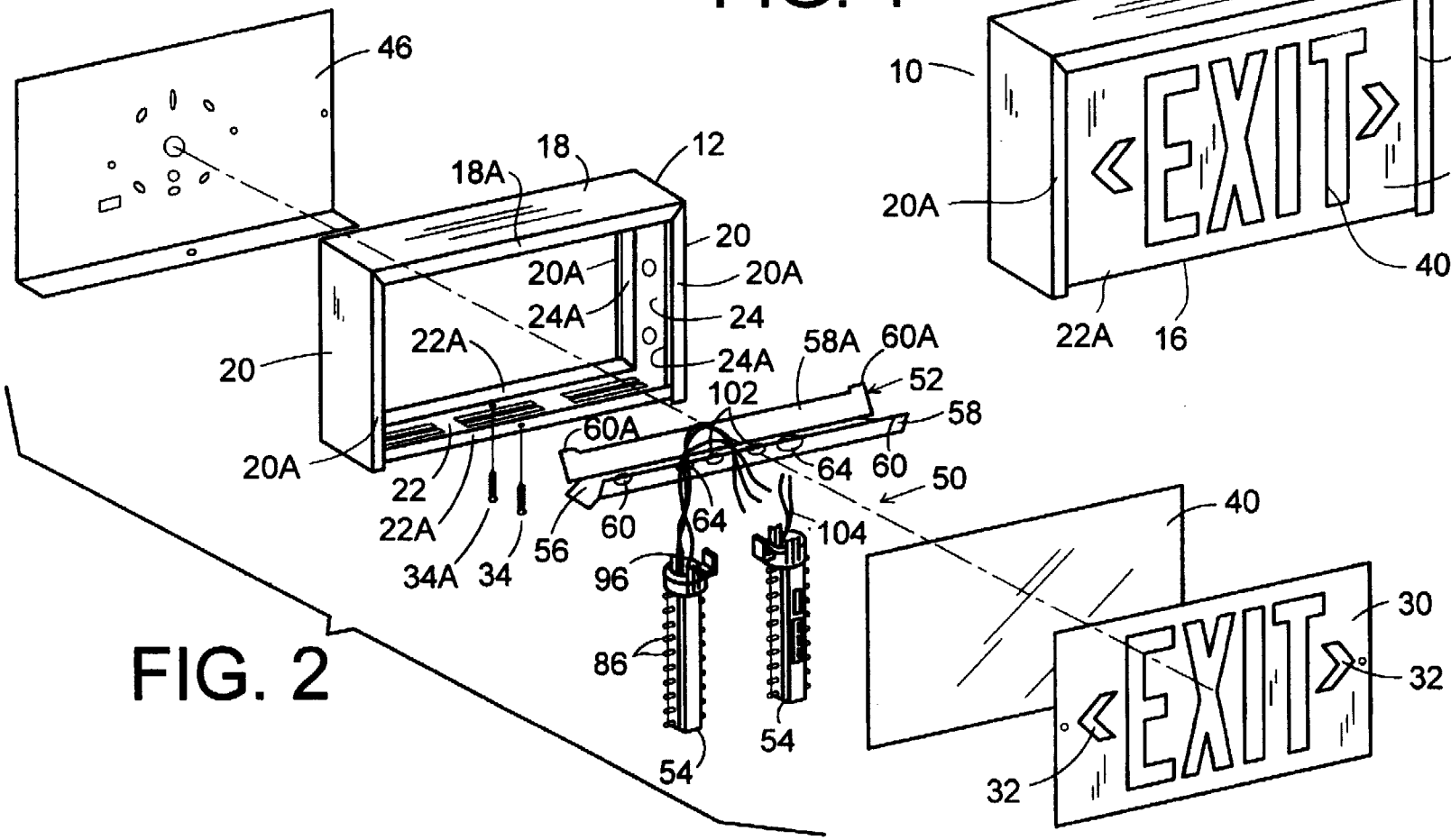
FIG. 2 is an exploded perspective view of the emergency sign depicted in FIG. 1.
Figure 8:
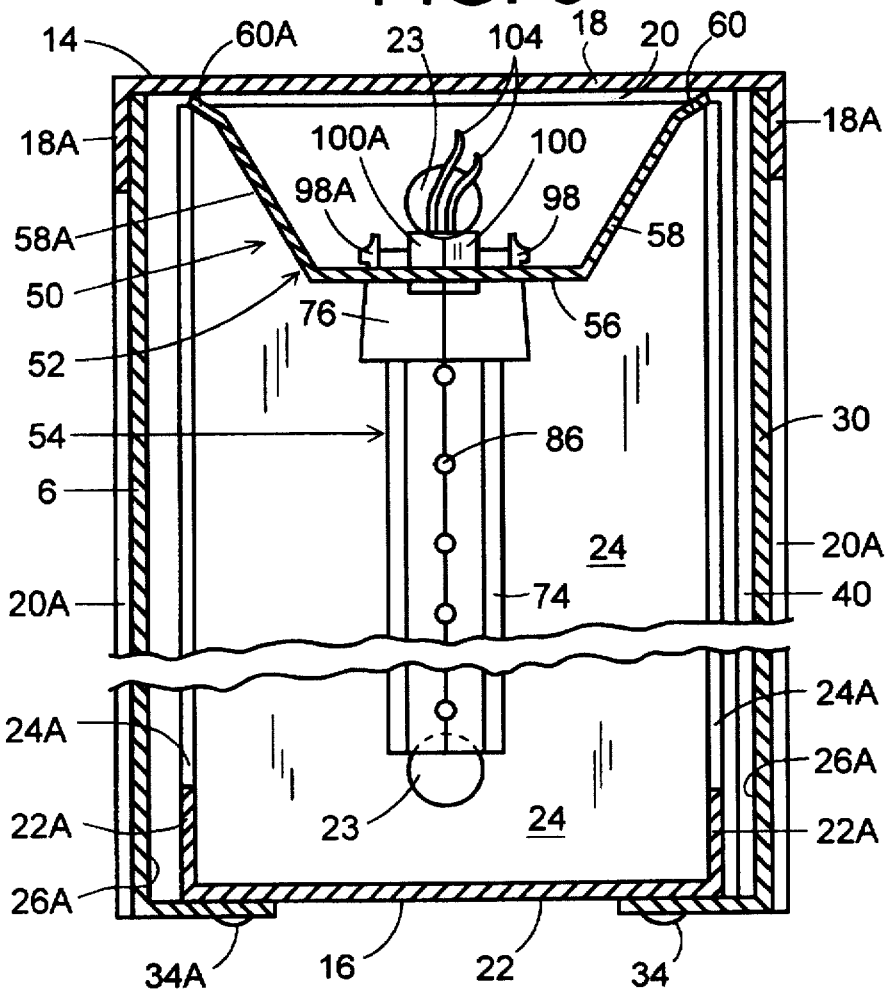
FIG. 8 is a sectional view taken along the line 8—8 in FIG. 7.
Figure 9:
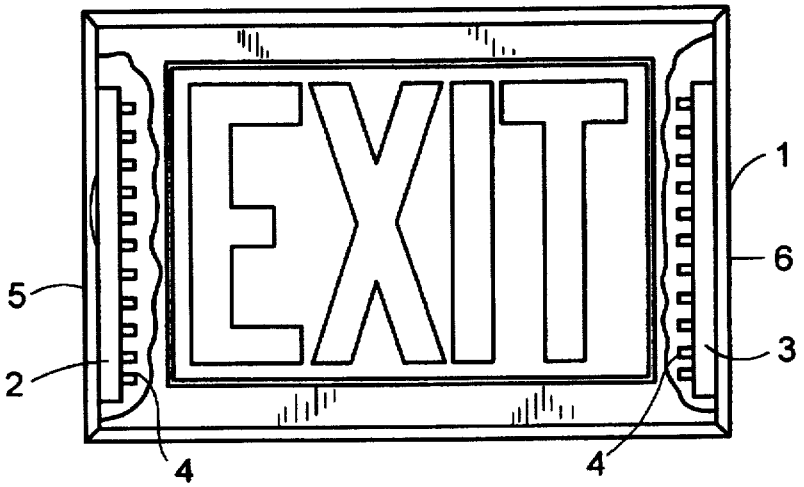
FIG. 9 (PRIOR ART)
FIG. 9 is a front elevational view, with portions thereof broken away, of a prior art emergency sign.

An emergency sign 10 comprises a housing 12 of a generally rectangular shape which defines an interior chamber. The housing is comprised of a pair of upper and lower segments 14, 16 which are secured together. The upper segment 14 is of inverted U-shape, and the lower segment 16 is of U-shape. Thus, as can be seen in FIGS. 2 and 8, the upper segment comprises a horizontal wall 18 and two parallel side walls 20 projecting downwardly from respective ends of the horizontal wall 18. The lower segment 16 comprises a horizontal wall 22 and a pair of parallel end walls 24 projecting upwardly from respective ends of the wall 22. (Only one end wall 24 is visible in FIG. 2.) The end walls 24 of the lower segment 16 are situated parallel to, and spaced inwardly from, the end walls 20 of the upper segment 14. The two segments can be interconnected in any suitable way, e.g., by spot welding or by embossing portions 23 (see FIG. 8) of the end wall 24 into the end 20. Each of the walls 18, 20, 22, 24 includes two flanges disposed in a vertical plane. Thus, wall 18 has flanges 18A, walls 20 have flanges 20A, wall 22 has flanges 22A, and walls 24 have flanges 24A.

The flanges 22A and 24A lie in a common first plane which is spaced inwardly from a second plane in which the flanges 18A, 20A lie. Thus, there is formed a downwardly open channel 26 (and 26A) between those planes (see FIG. 8).

Each side of the chamber is thus intersected by the end walls 20, 24. Extending across one side of the chamber is a stencil plate 30 from which certain indicia has been cut-out, such as the word "exit" together with one or more indicator arrow holes 32. That stencil plate 30 is installed upwardly into the channel 26 and is secured by a screw 34.

Disposed within the channel 26 to the inside of the stencil plate 30 is a diffuser plate 40 formed of a translucent plastic, preferably of red color.

If it is desired that an "exit" indicia be visible from both sides of the sign 10, then an identical arrangement of stencil plate 30 and diffuser plate 40 would be mounted in the other channel 26A. If not, then a cover plate 46 can instead be mounted within the channel 26A and secured by a screw 34A.

Disposed within the chamber is an illumination unit 50 comprised of a mounting plate 52 and two identical LED units 54 carried by the mounting plate 42. The units 54,54 are spaced from the end walls of the chamber, and are also spaced from opposite sides of a vertical plane P which bisects the chamber and extends perpendicular to the stencil plate 30. The mounting plate 52 includes a horizontal base portion 56 and two side portions 58, 58A inclined upwardly from respective edges of the base portion. Each side portion 58A includes identical outwardly projecting tabs 60, 60A. Those tabs are arranged to extend over the upper edges of the flanges 24A, as shown in FIG. 8, for retaining the mounting plate in place such that the base portion 56 is spaced below the top wall 18 of the housing.

The LED units 54 are mounting by snap fit within respective holes 64 formed in the base portion 56 of the mounting plate 52.

Figure 4:
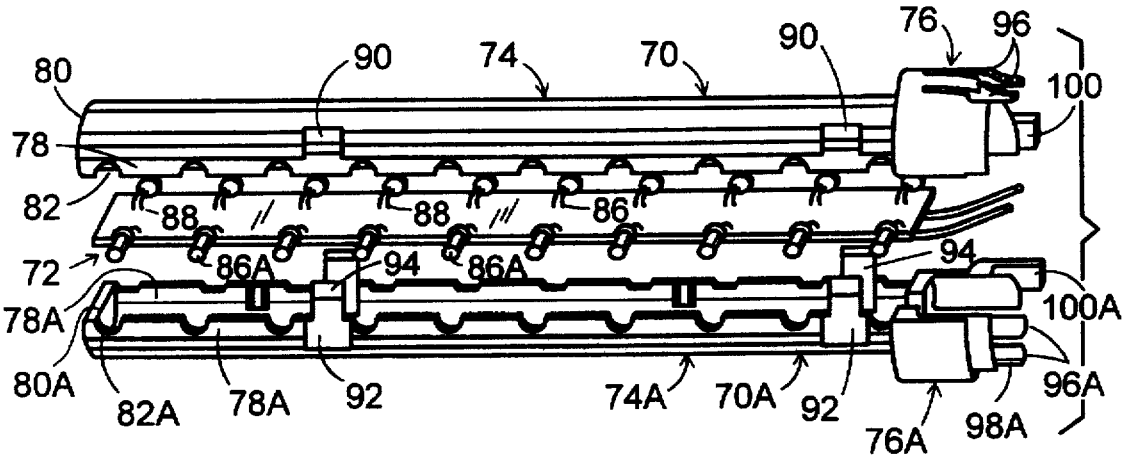
FIG. 4 is a perspective exploded view of an LED unit.
Figure 5:
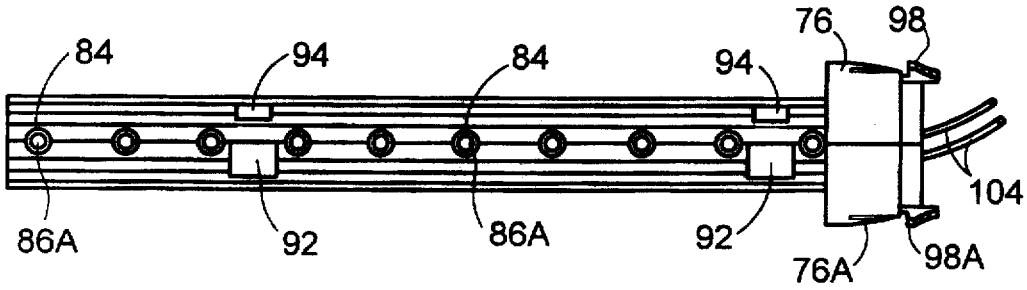
FIG. 5 is a side view of an LED unit.

A unit 54 is shown in an exploded perspective view in FIG. 4 and in an assembled condition in FIG. 5. The unit 54 comprises first and second housing halves 70, 70A and an LED circuit board 72 disposed between the housing halves. The second housing half 70A includes a body portion 74 and an anchoring portion 76 disposed at an upper end of the body portion 74. The body portion comprises a pair of side walls 78 interconnected by an end wall 80. Disposed between those walls is a space sized for receiving the LED circuit board 72. Likewise, the first housing half 70 includes a body portion 74, and an anchoring portion 76 configured to mate with the body portion 74A and anchoring portion 76A of the second housing half 70A to form therein a cavity for containing the LED circuit board 72.

Figure 7:
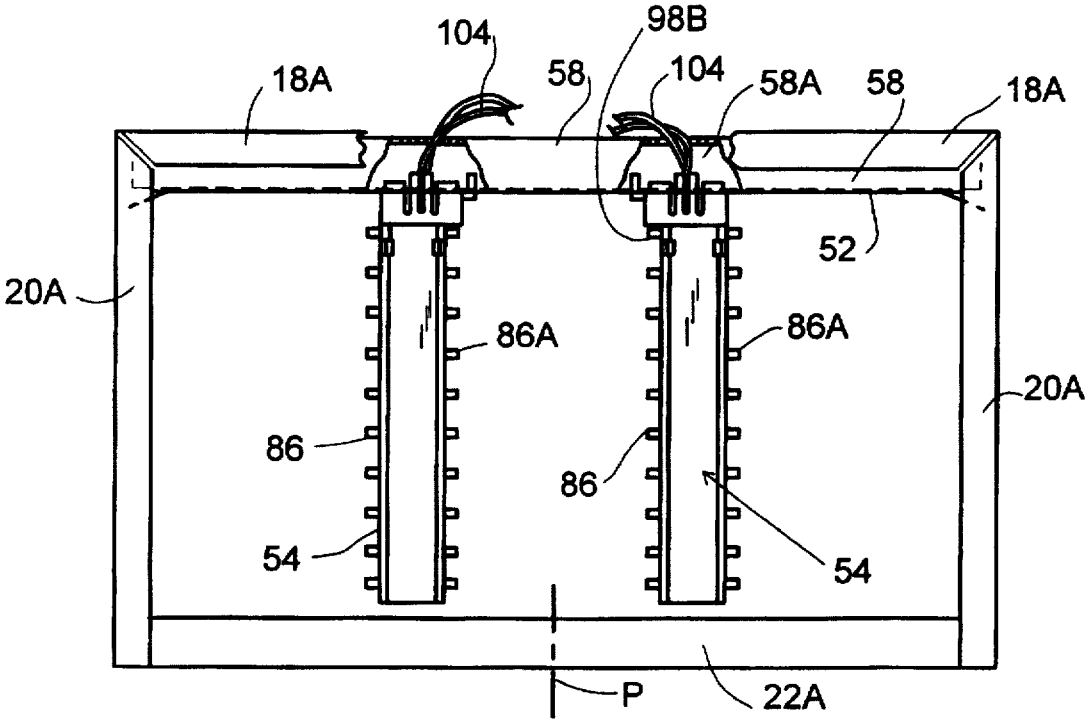
FIG. 7 is a front view of the emergency sign depicted in FIG. 1 with a stencil plate and diffuser plate thereof removed.

Each of the side walls 78, 78A has a plurality of semi-circular recesses 82, 82A formed therein so that when the housing halves 70, 70A have been assembled together, there is formed a circular recess 84 which receives an enlarged inner end 85 of a diode 86 or 86A of the LED circuit board 72. In that regard, the circuit board 72 carries two rows of light emitting diodes 86, 86A each row extending along a respective longitudinal edge of the board. Each diode is physically and electrically connected to the board by a pair of relatively stiff wires 88. When the housing halves 70, 70A are secured together, the wires 88 become clamped between the side walls 78, 78A, and the inner ends of the diodes are received in the circular recesses 84. The outer ends of the diodes project beyond the walls 78, 78A as shown in FIG. 7.

In order to secure the housing halves 70, 70A together, each side wall 78 of the first housing half 70 has two through-holes 90, and each side wall 78A of the second housing half 70A includes two resilient locking fingers 92. Each locking finger 92 is anchored at one end and its face end is elastically movable. The free end is defined by an enlarged head 94 which is cammed inwardly as the housing halves are brought together, and then snaps outwardly into a respective hole 90 once the housing halves have been brought sufficiently together. Hence, the housing halves are locked together and can only be unlocked by pushing the locking heads 94 inwardly and out of engagement with the sides of the holes 90.

Each of the anchoring portions 76, 76A includes a pair of resilient locking fingers 96 or 96A which have enlarged locking heads 98 or 98A at their free ends. Also, the anchoring portions include respective posts 100, 100A arranged to mate with one another when the housing halves 70, 70A are secured together.

Each of the LED units 54 can be installed into the mounting plate 52 by pushing the anchoring portion 76, 76A thereof through a respective one of the holes 64 formed in the base of the mounting plate 52. In so doing, the four locking fingers are cammed inwardly until the pairs of locking heads 98, 98A thereof have passed through the hole and snap back out to overlie the mounting plate 52, while a portion 98B of each unit 54 underlies a portion of the mounting plate, to prevent removal of the unit. At the same time, the posts 100, 100A pass through an aperture 102 formed in the base portion 56, so that rotation of the unit 54 about a vertical axis is prevented.

Leads 104 projecting from each unit 54 can be secured to a suitable wall or ceiling fixture, e.g. by being extended through a hole (not shown) formed in the wall 14 of the sign housing 12.

Figure 3:
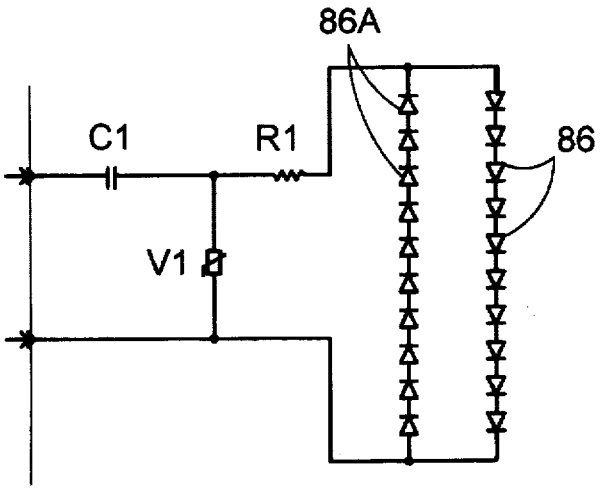
FIG. 3 is an electrical circuit for an LED unit of the emergency sign.

The circuit of the LED circuit board 72 is shown in FIG. 3. In that circuit, the diodes 86 (preferably ten in number) are interconnected in series to an AC source, and the diodes 86A (preferably ten in number) are also interconnected in series to the AC source. However, the row of diodes 86 is connected in reverse polarity from the row of diodes 86A. Therefore, at any given instant, only one row of diodes will be illuminated, thereby halving the overall power consumption. This reversal of polarity occurs instantaneously without any observable blinking or other visual distraction.

It will be appreciated that the LED units are not situated in reflector channels, but rather are directly exposed to the diffuser 40 so that there occurs direct impingement of the light against the diffuser. Hence, there occurs less loss of illumination through reflection as compared to signs in which LED light only reaches the diffuser by reflection.

Furthermore, the light transmitting characteristics of the diffuser 40 are preferably chosen to match the peak wavelength of the light emitted from the diodes. For example, if the emitted light from the diodes exhibits a wavelength of 660 nanometers, then the selected diffuser material would exhibit a transmittance frequency of 660 nanometers. This results in a relatively high efficient transmission of light, i.e., a transmittance of 65±3%. Of course, diodes emitting light with a peak frequency other than 660 nanometers could be used, whereupon a different diffuser would be selected.

Figure 6:
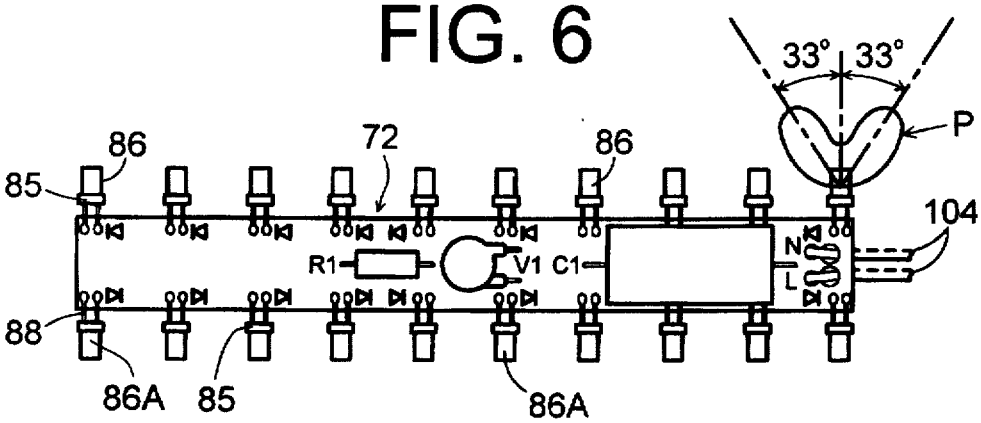
FIG. 6 is a plan view of a circuit plate of the LED unit.

The sign may be formed of any suitable materials. For example, the housing 12, stencil 30, mounting plate 52, and cover plate 46 are preferably formed of metal, although plastics could be used. The LED housing is formed of plastic, as is the diffuser plate 40. The diodes 86, 86A can be those made by I. I. Stanley, and others. The pattern P of emitted light for one of the diodes is depicted in broken lines in FIG. 6.

It will be appreciated from the foregoing that the present invention enables a high degree of illumination to be achieved per diode. That is, the diodes are not disposed within reflector channels, so the light emitted therefrom is directly exposed to the diffusers. Hence, the diffusers receive both direct and indirect light from the diodes. Furthermore, the diffuser has a light transmittance frequency which is matched to the peak wavelength of the light emitted from the diodes. The resulting high degree of light transmission enables the rows of diodes of each LED unit to be alternately illuminated, thereby halving the power consumption.

Furthermore, by configuring the anchoring portion of each LED unit of generally cylindrical shape, the LED units more closely simulate the configuration of a mounting socket of a conventional lamp in order to facilitate the retrofitting of conventional signs to utilize LED's. That is, the LED units can be mounted in the conventional mounting plates 52 provided in standard bulb-containing signs. Consequently, the standard sign housing need not be modified in order to receive the LED units 54, other than to utilize a diffuser (or diffusers) whose light transmittance frequency matches the peak wavelength of light emitted from the diodes.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An emergency sign, comprising:

a housing forming an interior chamber having opposing sides, said housing including a horizontal top wall;

a stencil plate extending across at least one of said sides and forming indicia;

a horizontal mounting plate mounted at an upper end of said chamber beneath said top wall, said mounting plate including an upwardly facing top surface, a downwardly facing bottom surface, and at least one hole;

an LED unit mounted on said mounting plate and having a body portion carrying a row of vertically spaced light emitting diodes, and an anchoring portion mounted in said hole, said anchoring portion including resilient locking fingers having enlarged heads for securing said LED unit to said mounting plate by inserting said anchoring portion upwardly through said hole with said locking fingers retracted inwardly within said hole, said locking fingers being movable elastically outwardly after said heads pass through said hole, whereby said heads extend above and across said top surface and a surface of said anchoring portion extends below and across said bottom surface, to vertically lock said LED unit; and a diffuser plate disposed between said stencil plate and said LED unit for diffusing light emitted from said diodes.

2. The emergency sign according to claim 1, wherein said housing includes opposing opaque end walls interconnecting said sides, said LED unit constituting a first LED unit, and further including a second LED unit spaced horizontally from said first LED unit, each LED unit carrying two vertical rows of light-emitting diodes, the diodes of one row projecting in an opposite direction from the diodes of the other row, the diodes being electrically connected in first and second groups, the diodes of each group being electrically series-connected, said groups being connected in parallel to an AC power line, said first group being connected in reverse polarity with respect to the second group so that when said first group is illuminated said second group is dark, and when said second group is illuminated said first group is dark, said LED units being spaced from said end walls and from one another, said LED units being spaced from opposite sides of a vertical plane which bisects said chamber and which extends perpendicular to said stencil plate; each of said LED units arranged such that said diodes of one row of diodes project toward one of said end walls, and the diodes of the other row of diodes project toward the other of said end walls, whereby said diffuser plate receives both reflected light and direct light from said diodes.

* * * * *